US007218216B1

(12) United States Patent
Uehran

(10) Patent No.: US 7,218,216 B1
(45) Date of Patent: May 15, 2007

(54) REFEREE'S WIRELESS HORN INDICATOR SYSTEM

(75) Inventor: Randy S. Uehran, Brookings, SD (US)

(73) Assignee: Daktronics, Inc., Brookings, SD (US)

( * ) Notice: Subject to any disclaimer, the term of this patent is extended or adjusted under 35 U.S.C. 154(b) by 159 days.

(21) Appl. No.: 11/033,194

(22) Filed: Jan. 11, 2005

(51) Int. Cl.
*G08B 23/00* (2006.01)

(52) U.S. Cl. ..... 340/517; 368/10

(58) Field of Classification Search ..... 340/517, 340/539.11, 323 R; 368/10, 109
See application file for complete search history.

(56) References Cited

U.S. PATENT DOCUMENTS 3,969,886 A * 7/1976 Yoda ..... 368/73
4,526,479 A * 7/1985 Harris ..... 368/284
5,027,102 A * 6/1991 Sweeny ..... 340/323 R
5,293,354 A * 3/1994 Costabile ..... 368/11
6,369,697 B1 * 4/2002 Poole ..... 340/573.1
6,603,711 B2 * 8/2003 Calace ..... 368/109
7,031,225 B2 * 4/2006 McDonald ..... 368/10

* cited by examiner

*Primary Examiner*—John Tweel, Jr.
(74) *Attorney, Agent, or Firm*—Hugh D. Jaeger, Esq.

(57) ABSTRACT

Referee's wireless horn indicator system for aiding a referee in accurately officiating in a sports event. The system includes a controller and a sensory receiver. The controller includes the official time clock for the sports event, a control circuit coupled to the official time clock, and a radio transmitter activated by the control circuit for sending a radio signal to the sensory receiver. The sensory receiver is worn by the referee, for instance on the wrist, and includes a radio receiver and a sensory stimulating device such as a vibrator, both battery powered. Upon the official time clock reaching zero, a signal is sent by the transmitter to the radio receiver which then activates the sensory stimulating device to impart a tactual signal to the referee, thereby apprizing him of the expiration of the time period.

11 Claims, 1 Drawing Sheet

REFEREE'S WIRELESS HORN INDICATOR SYSTEM

CROSS REFERENCES TO CO-PENDING APPLICATIONS

None.

BACKGROUND OF THE INVENTION

1. Field of the Invention

The present invention is for a referee's wireless horn indicator system.

2. Description of the Prior Art

Self-contained timing devices which are worn by a sports official and which generate a tactile signal upon expiration of a predetermined time period in a sports event are known; however, all such known devices are independent of the official timepiece incorporated for determining the end of such time period and thus frequently lead to time discrepancies due to system inaccuracies. The present invention relates to a device for aiding a sports official, such as a referee, to determine with greatly increased certainty whether or not a particular action occurred before the time clock reached zero. For example, in basketball oftentimes a player is attempting to make a last second shot and the referee must determine if the shot was made prior to the time clock hitting zero. Aside from the difficulty of trying to watch both the athletes and the time clock at the same time, sometimes the crowd is so loud that the buzzer or horn cannot be heard. As a result, the referee may make an incorrect call. The invention solves the problem by providing a referee with a portable, battery operated, radio controlled and linked vibrator device which is synchronized with and linked to the official time clock and which imparts a tactual (vibratory) signal to the referee upon the time clock reaching zero.

Thus, even though the referee may fail to hear the buzzer or horn, he will know from the tactual signal when the time expired and, therefore, will be able to make the proper call. The device is similar to a paging device in size and operation.

SUMMARY OF THE INVENTION

The general purpose of the present invention is a referee's wireless horn indicator system.

According to one embodiment of the present invention, there is provided a referee's wireless horn indicator system, the major components thereof consisting of a portable, battery operated, radio controlled and linked vibrator device, herein called the sensory receiver, and a controller which transmits time information to the sensory receiver. The sensory receiver can be worn at any suitable location on the body of the referee, an example being on the wrist. The controller includes a display and clock which interfaces with a scoreboard via a control circuit and also includes controlling circuitry and a transmitter for transmitting essential clock generated time information or, optionally, other information, to the sensory receiver. Upon the time clock reaching zero, the controller transmits a signal to the sensory receiver. The sensory receiver receives the transmitted information from the controller and activates a vibrator and/or optional auditory sensory alerting device(s) to alert the referee that the time period has ended. The sensory receiver can also include control switches and one or more LED displays which can display time or other such desired information, if desired.

One significant aspect and feature of the present invention is a referee's wireless horn indicator system including a controller and a sensory receiver.

Another significant aspect and feature of the present invention is referee's wireless horn indicator system wherein a wireless signal is synchronized with and sent from a controller to a sensory receiver to alert a referee that a time period has ended.

Still another significant aspect and feature of the present invention is a referee's wireless horn indicator system by which the referee is alerted by tactual stimulation that a time period has ended.

Yet another significant aspect and feature of the present invention is a referee's wireless horn indicator system incorporates a sensory receiver which overcomes crowd and other noise or visual interference.

A further significant aspect and feature of the present invention is referee's wireless horn indicator system wherein a vibratory, an auditory or both an vibratory and an auditory sensory alert may be used to sense the end of a time period.

Having thus briefly described embodiments, as well as significant aspects and features, of the present invention, it is the principal object of the present invention to provide a referee's wireless horn indicator system.

BRIEF DESCRIPTION OF THE DRAWING

Other objects of the present invention and many of the attendant advantages of the present invention will be readily appreciated as the same becomes better understood by reference to the following detailed description when considered in connection with the accompanying drawing, wherein:

The single FIGURE illustrates a referee's wireless horn indicator system, the present invention.

DETAILED DESCRIPTION OF THE PREFERRED EMBODIMENTS

Figure 1:
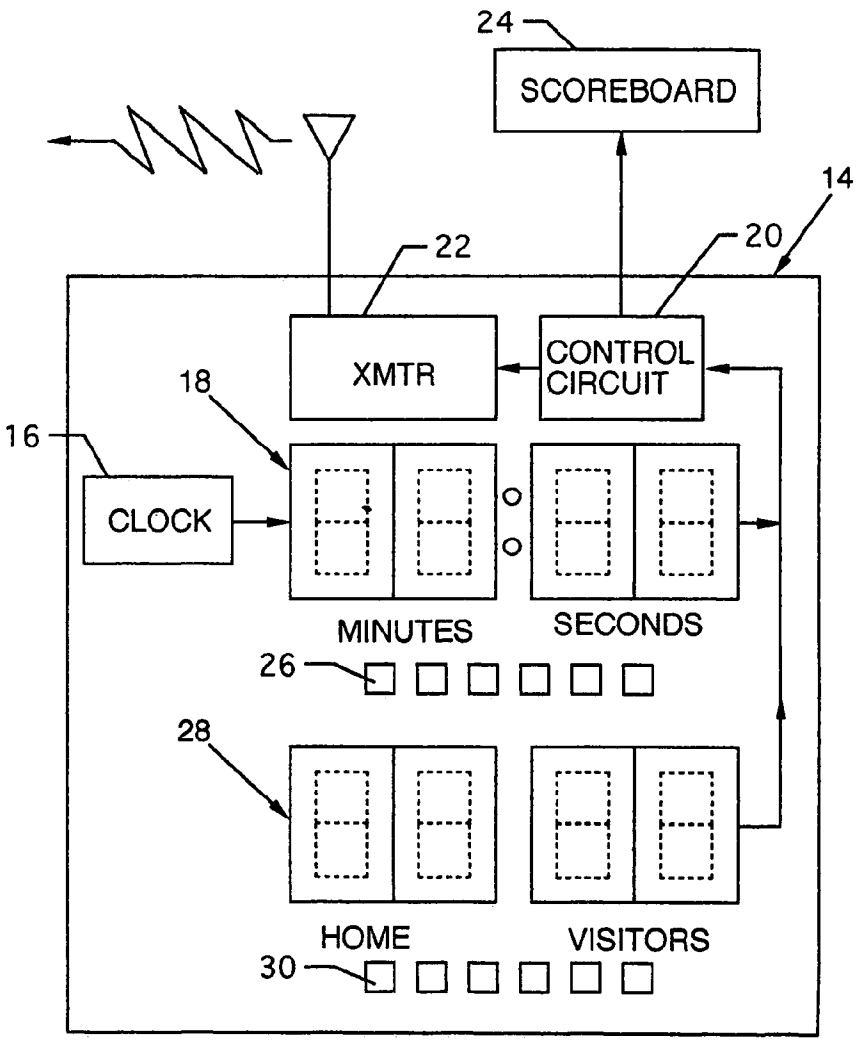
Figure 1:
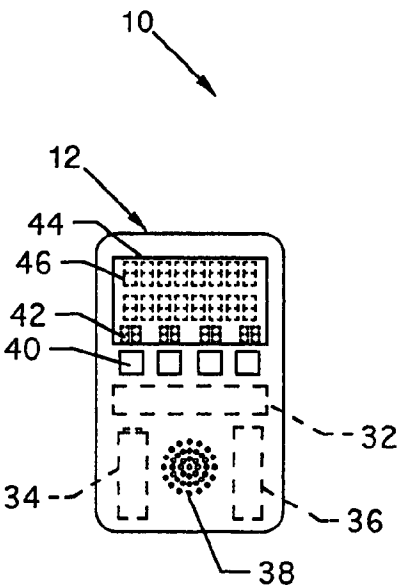

The single drawing FIGURE illustrates a plan view of the referee's wireless horn indicator system 10, the present invention, the major components of which include a sensory receiver 12 and a controller 14. The controller 14 includes a clock 16, which may be digital, having an alpha-numeric digital light emitting diode (LED) or other suitable time display 18, which is inputted to a control circuit 20. The control circuit 20 senses the time period ending and other time information with reference to the clock 16 and/or display 18 and incorporates a transmitter 22 to transmit a digital or other signal to the sensory receiver 12. Optionally, the control circuit 20 can send timing information to an external scoreboard 24 if desired. A row of control switches 26 provides for simultaneous control of the clock 16 and time display 18 such as, but not limited to, starting, stopping and resetting of the clock 16 and time display 18. An optional alpha-numeric digital light emitting diode (LED) or other suitable score display 28 and optional row of control switches 30 is provided to send scoring information to the scoreboard 24 or sensory receiver 12 via the control circuit 20 and transmitter 22 as required.

The sensory receiver 12 includes a radio receiver 32 for receiving signals from the transmitter 22 of the controller 14. The sensory receiver 12 and the components contained therein are powered by one or more batteries 34. Sensory stimulating devices include a vibrator 36 and an optionally included piezoelectric horn 38 which are activated upon receiving by the radio receiver 32 an appropriate signal from the controller 14. Sensory stimulation can be provided in several ways. The vibrator 36 is the primary stimulatory provider which can be utilized as the sole source of stimulation. Optionally, the piezoelectric horn 38 can be used in concert with and to supplement the vibrator 36 or can be utilized by itself. A row of control switches 40 can be used to select the desired stimulatory devices. The control switches 40 can also be used to control other functions of the sensory receiver such as strength of the vibrator 36 or piezoelectric horn 38. The settings of the control switches 40 can also be annunciated by characters or icons 42 found in the lower region of a display window 44 which can contain LED or other suitable alpha-numeric readouts. One or more rows 46 of time or scoring or other desirable information can be included in the upper region of the display window 44.

Various modifications can be made to the present invention without departing from the apparent scope hereof.

PARTS LIST

10 referee's wireless horn indicator system
12 sensory receiver
14 controller
16 clock
18 time display
20 control circuit
22 transmitter
24 scoreboard
26 switches
28 score display
30 control switches
32 radio receiver
34 battery
36 vibrator
38 piezoelectric horn
40 control switches
42 characters or icons
44 display window
46 rows

The invention claimed is:

1. A process for informing a field referee officiating a timed sports event comprising the steps of:

providing a sports controller including an event clock with event time information and a signal transmitter connected to said event clock;

providing a wearable sensory receiver, the wearable sensory receiver including:

a receiver for receiving the signal from the signal transmitter;

a battery power source;

a vibrator alerting device; and, a row of control switches, which row of control switches select vibratory strength of the vibratory alerting device;

installing the wearable sensory receiver on the field referee and selecting a vibratory strength for the vibratory alerting device; and, detecting an event time information occurrence on the event clock with the sports controller and transmitting a signal from the sports controller to the sensory receiver so as to vibratingly alert the field referee to the detection of the event time information at the selected vibratory strength of the vibratory alerting device.

2. The process of claim 1, wherein the wearable sensory receiver further includes a plurality of alerting devices and the row of switches allows selection of one or more of the alerting devices of the plurality of alerting devices and further wherein the vibratingly alert of the field referee involves the selected one or more of the alerting devices of the plurality of alerting devices.

3. The process of claim 2, wherein the plurality of alerting devices includes a vibrator and a piezoelectric horn.

4. The process of claim 1, wherein the wearable sensory receiver further includes a display window, which display window indicates the setting condition of the row of switches.

5. The process of claim 2, wherein the plurality of alerting devices includes a vibrator and a piezoelectric horn and further including a display window indicating the selected vibratory strength the vibrator and the selected strength of the piezoelectric horn.

6. The process of claim 1, wherein the wearable sensory receiver further includes a display window, which display window displays information from the sports controller selected from the group consisting of score and event time information.

7. The process of claim 6, wherein the wearable sensory receiver further includes a plurality of alerting devices and the row of switches further allows selection of one or more of the alerting devices of the plurality of alerting devices and further wherein the vibratingly alert of the field referee involves the selected one or more of the alerting devices of the plurality of alerting devices and the display window displays the selected alerting devices and selected strength of each alerting device of the plurality of alerting devices.

8. The process of claim 7, wherein the selected strength of each alerting device is displayed upon a lower section of the display window and the selected information from the sports controller is displayed upon an upper section of the display window.

9. The process of claim 8, wherein the display window displays alpha-numeric information.

10. The process of claim 9, wherein the alpha-numeric information is conveyed by LEDs.

11. The process of claim 1, further including the step of:

providing a scoreboard and communicating display information from the sports controller to the scoreboard.

* * * * *